US011823652B2

(12) United States Patent
Nagata

(10) Patent No.: US 11,823,652 B2
(45) Date of Patent: Nov. 21, 2023

(54) CHORD-PLAYING INPUT DEVICE, ELECTRONIC MUSICAL INSTRUMENT, AND CHORD-PLAYING INPUT PROGRAM

(71) Applicant: InstaChord Corp., Tokyo (JP)

(72) Inventor: Yuichi Nagata, Shizuoka (JP)

(73) Assignee: INSTACHORD CORP., Tokyo (JP)

( * ) Notice: Subject to any disclaimer, the term of this patent is extended or adjusted under 35 U.S.C. 154(b) by 69 days.

(21) Appl. No.: 17/616,190

(22) PCT Filed: Jun. 12, 2019

(86) PCT No.: PCT/JP2019/023230
§ 371 (c)(1),
(2) Date: Dec. 3, 2021

(87) PCT Pub. No.: WO2020/250333
PCT Pub. Date: Dec. 17, 2020

(65) Prior Publication Data

US 2022/0319484 A1 Oct. 6, 2022

(51) Int. Cl.
*G10H 1/38* (2006.01)
*G10H 1/34* (2006.01)

(52) U.S. Cl.
CPC ..... *G10H 1/386* (2013.01); *G10H 1/342* (2013.01); *G10H 2210/591* (2013.01);
(Continued)

(58) Field of Classification Search
CPC .. G10H 1/386; G10H 1/342; G10H 2210/591; G10H 2210/611;
(Continued)

(56) References Cited

U.S. PATENT DOCUMENTS 3,305,620 A * 2/1967 Young ..... G10H 1/38 84/DIG. 22
4,140,039 A * 2/1979 Faulkner ..... G10H 1/38 84/715
(Continued)

FOREIGN PATENT DOCUMENTS

FR 2652432 A1 3/1991
JP S5343496 A 4/1978
(Continued)

OTHER PUBLICATIONS

Extended European Search Report in Application No. 19932780.0, dated Dec. 5, 2022, 8pp.
(Continued)

*Primary Examiner* — Jeffrey Donels
(74) *Attorney, Agent, or Firm* — HAUPTMAN HAM, LLP

(57) ABSTRACT

An electronic musical instrument includes: a chord-playing input device; a sounding part that emits chord sounds; and a display part that displays an image. The chord-playing input device includes: a chord designating button group assigned with chords; a chord changing button group assigned with change methods for changing an assignment state for the chord designating button group; a sounding information generating part that generates sounding information for making the sounding part emit the sound of the chord corresponding to operation for the chord designating button group and chord changing button group; and a display information generating part that generates display information for making the display part display a plurality of chord images and change method images in the same arrangement order as those of the chord designating button group and chord changing button group.

10 Claims, 12 Drawing Sheets

(52) U.S. Cl.
CPC . *G10H 2210/611* (2013.01); *G10H 2210/616* (2013.01); *G10H 2210/621* (2013.01); *G10H 2210/626* (2013.01)

(58) Field of Classification Search
CPC ..... G10H 2210/616; G10H 2210/621; G10H 2210/626
USPC ..... 84/637
See application file for complete search history.

(56) References Cited

U.S. PATENT DOCUMENTS

| | | | | |
|---|---|---|---|---|
| 4,178,823 | A | 12/1979 | McCoskey et al. | |
| 5,440,071 | A * | 8/1995 | Johnson | G10H 1/34 84/645 |
| 6,046,396 | A | 4/2000 | Miyamoto | |
| 6,111,179 | A * | 8/2000 | Miller | G10D 1/085 84/669 |
| 6,753,466 | B1 * | 6/2004 | Lee | G10H 1/342 84/669 |
| 10,269,335 | B1 * | 4/2019 | O'Hair | G10H 1/0008 |
| 10,818,279 | B1 * | 10/2020 | Swanson | G10H 1/386 |
| 2010/0294112 | A1 | 11/2010 | Asakura et al. | |
| 2013/0104725 | A1 * | 5/2013 | Little | G10H 1/386 84/613 |

FOREIGN PATENT DOCUMENTS

| | | | |
|---|---|---|---|
| JP | S56-92594 | A | 7/1981 |
| JP | S57135995 | A | 8/1982 |
| JP | 2001318677 | A | 11/2001 |
| JP | 200240921 | A | 2/2002 |
| JP | 2004117789 | A | 4/2004 |
| JP | 200599174 | A | 4/2005 |
| JP | 201960945 | A | 4/2019 |

OTHER PUBLICATIONS

Ireal Pro, "Input a complete song in iReal Pro in uder 3 minutes (iOS)", Youtube, Oct. 13, 2015, URL:https://www.youtube.com/watch?v=jo9yOlBrl9g, 1pp.

* cited by examiner

CHORD-PLAYING INPUT DEVICE, ELECTRONIC MUSICAL INSTRUMENT, AND CHORD-PLAYING INPUT PROGRAM

CROSS-REFERENCE TO RELATED APPLICATIONS

The present application is a National Phase of International Application No. PCT/JP2019/023230 filed Jun. 12, 2019, the entire contents of which are incorporated herein by reference.

TECHNICAL FIELD

The present invention relates to a chord-playing input device, an electronic musical instrument, and a chord-playing input program.

BACKGROUND ART

There is conventionally known an electronic musical instrument enabling even a player who does not know the constituent notes of chords to play musical performance based on a plurality of chords by designating chord names (G, F, C, Am, etc.).

For example, Patent Document 1 discloses an electronic musical instrument provided with 27 chord select buttons corresponding to 27 chords.

CITATION LIST

Patent Document

Patent Document 1: JP 53-043496 A

DISCLOSURE OF THE INVENTION

Problems to be Solved by the Invention

However, in the electronic musical instrument disclosed in Patent Document 1, chords and buttons are one-to-one correspondence, so that 27 buttons are arranged for 27 chords. Thus, a predetermined space is required to arrange 27 buttons of a size that is easy to depress for a player. It follows that when there is a need to add new chords, it is necessary to increase the number of buttons by the number of chords to be added, thus requiring more space. Further, when the number of buttons is large, it is troublesome for a player to find a target button, and the distance between the buttons disposed at opposite ends increases, thus deteriorating operability.

The present invention has been made in view of such circumstances, and it is therefore an object thereof to provide a chord-playing input device, an electronic musical instrument, and a chord-playing input program capable of generating a larger number of types of chords that can be played than the number of buttons and having improved operability at performance.

Means for Solving the Problems

The present invention has been made to solve the above problems, and a chord-playing input device according to one embodiment of the present invention includes: a plurality of chord designating buttons arranged on a casing and assigned respectively with chords; a plurality of chord changing buttons arranged on the casing side by side with the chord designating buttons and assigned respectively with change methods for changing an assignment state of the chords for the chord designating buttons; a sounding information generating part that generates sounding information for making a sounding part emit the sound of the chord corresponding to operation for any of the chord designating buttons and chord changing buttons; and a display information generating part that generates display information for making a display part display a plurality of chord images corresponding to the chords assigned respectively to the chord designating buttons and a plurality of change method images corresponding to the change methods assigned respectively to the chord changing buttons in the same arrangement order as those of the chord designating buttons and chord changing buttons.

An electronic musical instrument according to one embodiment of the present invention includes: the above chord-playing input device; a sounding part that emits the sound of the chord based on sound information generated by the sound information generating part; and a display part that displays the chord images and change method images based on display information generated by the display information generating part.

A chord-playing input program according to one embodiment of the present invention is a program executed by a computer that controls a plurality of chord designating buttons arranged on a casing and assigned respectively with chords and a plurality of chord changing buttons arranged on the casing side by side with the chord designating buttons and assigned respectively with change methods for changing an assignment state of the chords for the chord designating buttons, the program allowing the computer to function as a sounding information generating part that generates sounding information for making a sounding part emit the sound of the chord corresponding to operation for any of the chord designating buttons and chord changing buttons, and a display information generating part that generates display information for making a display part display a plurality of chord images corresponding to the chords assigned respectively to the chord designating buttons and a plurality of change method images corresponding to the change methods assigned respectively to the chord changing buttons in the same arrangement order as those of the chord designating buttons and chord changing buttons.

Advantageous Effects of the Invention

According to the chord-playing input device, electronic musical instrument, and chord-playing input program of one embodiment of the present invention, the sounding information generating part generates the sounding information for making the sounding part emit a chord corresponding to a combination of the plurality of operated chord designating and changing buttons. At this time, the chord assignment state for the plurality of chord designating buttons is changed according to the change methods assigned to the plurality of chord changing buttons, so that the number of chords that can be played is determined according to the number of chord designating buttons and the number of chord changing buttons. Thus, according to the chord-playing input device, electronic musical instrument, and chord-playing input program of one embodiment of the present invention, it is possible to generate a larger number of types of chords that can be played than the number of the chord designating buttons.

Further, the display information generating part generates display information for making the display part display the plurality of chord images and the plurality of change method images in accordance with the arrangement order of the plurality of chord designating buttons and chord changing buttons before and after the chord assignment state is changed. Thus, a player can easily grasp the arrangement state of the plurality of chord designating buttons and chord changing buttons, as well as the chords emitted when each button is operated (including a chord after the assignment state has been changed). Therefore, according to the chord-playing input device, electronic musical instrument, and chord-playing input program of one embodiment of the present invention, the operability during a musical performance can be improved.

BRIEF DESCRIPTION OF THE DRAWINGS

FIGS. 1A and 1B illustrate a configuration example of an electronic musical instrument 1 according to the embodiment of the present invention, in which FIG. 1A is a front view, and FIG. 1B is a top view.

MODE FOR CARRYING OUT THE INVENTION

An embodiment of the present invention will be described with reference to the accompanying drawings.

(Configuration of Components Constituting Electronic Musical Instrument 1)

Figure 1A:
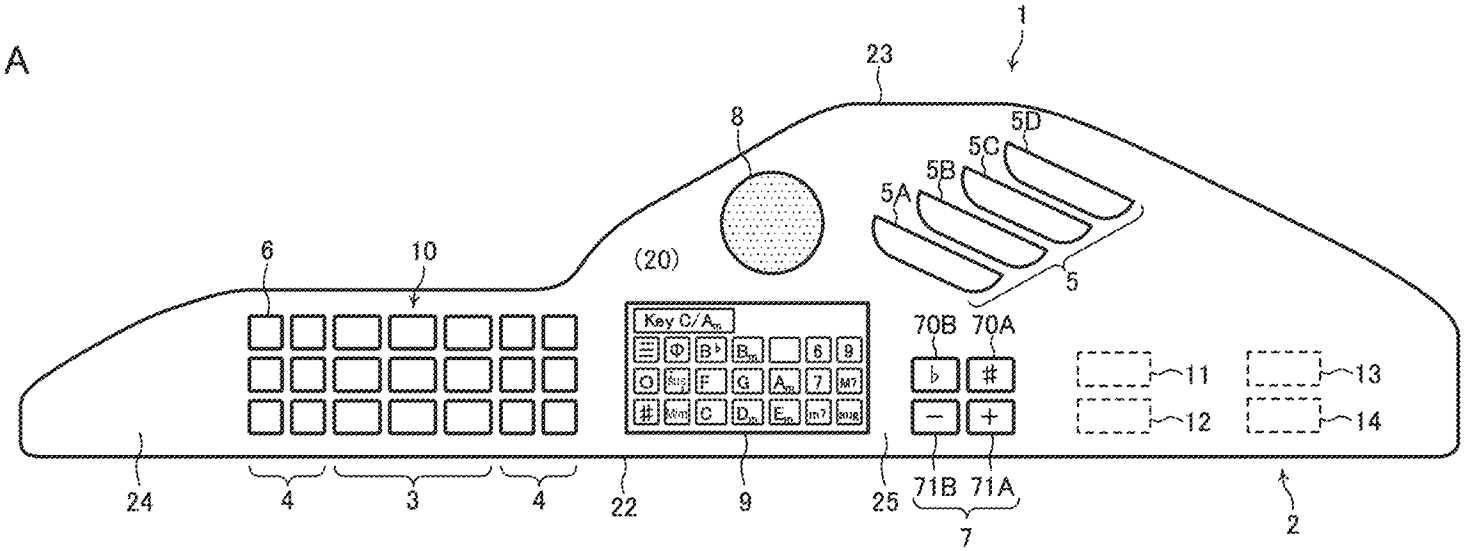
Figure 1B:
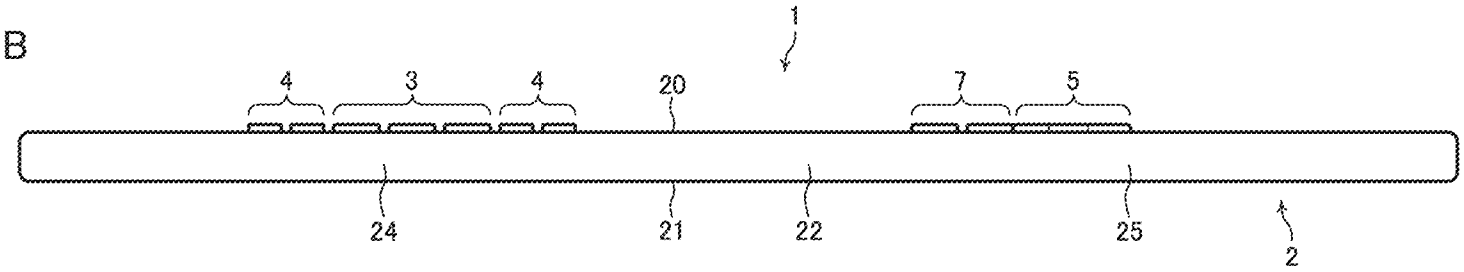
Figure 2:
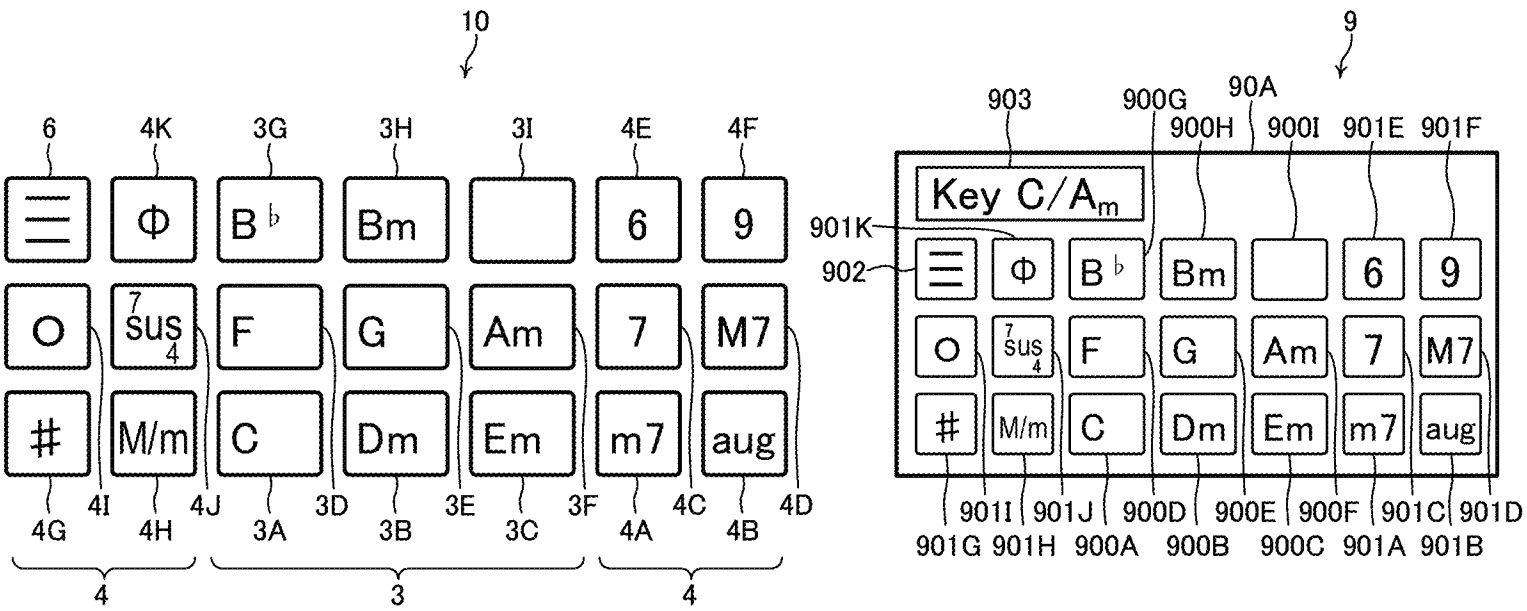
FIG. 2 is an enlarged view of a chord designating button group 3, a chord changing button group 4, and a display part 9 which are included in the electronic musical instrument 1 according to the embodiment of the present invention.

FIGS. 1A and 1B illustrate a configuration example of an electronic musical instrument 1 according to the embodiment of the present invention. FIG. 1A is a front view and FIG. 1B is a top view. FIG. 2 is an enlarged view of a chord designating button group 3, a chord changing button group 4, and a display part 9 which are included in the electronic musical instrument 1 according to the embodiment of the present invention.

The electronic musical instrument 1 is an instrument with which a player can perform music based on a plurality of chords while operating a chord-playing input device 10 with one or both hands.

The electronic musical instrument 1 has a flat-plate casing 2. There are arranged on a surface 20 of the casing 2 a chord designating button group 3, a chord changing button group 4, a pad group 5, a menu button 6, an option button group 7, a sounding part 8, and a display part 9. The electronic musical instrument 1 further has a control part 11, a storage part 12, a battery 13, and an external I/F (interface) part 14 each of which is incorporated in the casing 2.

The casing 2 is made of wood, resin, metal, or the like and has an entire length of about 400 mm to 500 mm and a thickness of about 10 mm. The casing 2 simulates the shape of a guitar and includes a neck part 24 corresponding to the guitar neck and a body part 25 corresponding to the guitar body. The size and shape of the casing 2 may be modified as needed.

A player plays the electronic musical instrument 1 with an upper surface 22 of the casing 2 facing upward while grasping the neck part 24 with the left hand and holding the body part 25 with the right hand. Alternatively, the player may play the electronic musical instrument 1 in a state where it is placed on, for example, a table with a back surface 21 of the casing 2 facing the table.

The chord designating button group 3 includes a plurality of chord designating buttons 3A to 3I, which are arranged on the neck part 24. The chord designating buttons 3A to 3I each have, for example, a rectangular shape and are arranged in a two-dimensional or staggered array. In the present embodiment, nine chord designating buttons 3A to 3I are arranged in a two-dimensional array of three rows and three columns.

The chord designating buttons 3A to 3I are assigned with mutually different chords. Specifically, the chord designating buttons 3A to 3I are each assigned with a first root and a first chord type which constitute each individual chord. The assignment state of the chords assigned respectively to the chord designating buttons 3A to 3I is not fixed, but can be changed according to a plurality of change methods (details thereof will be described later).

The "chord" refers to a combination of at least three or more constituent notes having mutually different pitches with reference to the root which is the lowest note of the chord. Each chord is identified based on a "root" and a "chord type" that characterizes constituent notes (third, fifth, seventh, tension, etc.) other than the root and represented by a chord name. For the "code name", the "root" is written in uppercase letters (A to G), and the "chord type" is written in alphanumeric characters and Greek letters placed to the right of the uppercase letters (A to G).

For the "root", "♭" or "#" is optionally written to the uppercase letters (A to G). The "chord type" (whose name is shown in each parenthesis) is, for example, "m" (minor), "m7" (minor seventh), "aug" (augment), "7" (seventh), "M7" (major seventh), "6" (six), "9" (ninth), "O" (diminished), "7sus4" (seventh sus four), "Φ" (half diminished). In addition, "O" is a simplified notation of "dim7", and "Φ" is a simplified notation of "m7♭5". When the "chord type" is "M" (major), the notation of "M" is omitted.

In addition, chords include major triads of I, IV, and V, and sub-triads of II, III, VI, and VII, and the basic roots are limited to seven types. Furthermore, for example, in a triad in a natural major chord, the basic chord types are limited to major chords (when the roots are I, IV, V), minor chords (when the roots are II, III, VI) and diminished chords (when the root is VII).

Therefore, in the present embodiment, in order for the first root note and the first chord type constituting each chord to be narrowed down to the basic root and chord type as described above and to be arranged regularly, seven chords represented by the code names "C", "Dm", "Em", "F", "G", "Am", and "Bm" are assigned respectively to the seven chord designating buttons 3A to 3F and 3H as the initial assignment state. Further, as a chord that is used more frequently than other chords, one chord designating button 3G is assigned with a chord represented by the chord name "B♭" as the initial assignment state. In the present embodiment, although it is assumed that no chord is assigned to one chord designating button 3I, any chord may be assigned to the chord designating button 3I as well.

In FIG. 2, for the sake of explanation, the above chord names are labeled to the eight chord designating buttons 3A to 3H. When the chord designating buttons 3A to 3I are configured to display a character string, a chord name indicating a chord assigned to each of the chord designating buttons 3A to 3I may be displayed in the form of a character string.

The chord changing button group 4 includes a plurality of chord changing buttons 4A to 4K, which are arranged side by side with the chord designating buttons 3A to 3I on the neck part 24. The chord changing buttons 4A to 4K each have, for example, a square shape and are arranged adjacent to the chord designating button group 3 in a two-dimensional or staggered array.

In the present embodiment, six chord changing buttons 4A to 4F are arranged to the right of the chord designating button group 3 in a two-dimensional array of three rows and two columns. Further, five chord changing buttons 4G to 4K and menu button 6 are arranged to the left of the chord designating button group 3 in a two-dimensional array of three rows and two columns. The chord designating buttons 3A to 3I and chord changing buttons 4A to 4K are arranged within a range operable with one hand. The chord changing buttons 4A to 4K only need to be arranged adjacent to the chord designating button group 3. That is, for example, the chord changing buttons 4A to 4K may be arranged on one side of the chord designating button group 3 or may be arranged so as to surround the chord designating button group 3.

The chord changing buttons 4A to 4K are assigned respectively with a plurality of change methods for changing the chord assignment state for the chord designating buttons 3A to 3I.

The "change method" is a method of changing at least one of the first root and the first chord type constituting each chord assigned to the chord designating buttons 3A to 3I according to a predetermined rule. In the present embodiment, the change method is classified into the following three.

(a) First Change Method

In the first change method, a second chord type is added to the first chord type, or the first chord type is replaced with the second chord type to change the assignment state. The chord designating buttons 3A to 3I are each assigned with the second chord type to change the assignment state according to the first change method. As for the cases of "addition" and "replacement", when the first chord type and second chord type are both applied, the second chord type is added to the first chord type, and otherwise, the first chord type is replaced with the second chord type. The first chord type may be replaced with the second chord type in some situations even when the first and second chord types are both applied.

Specifically, in the first change method, assuming that the chord name indicating a chord to be changed is "Am" and that "M7" or "aug" is specified as the second chord type, the characteristics of the constituent note designated as the second chord type ("M7") is added to the first chord type "m", or the first chord type "m" is replaced with the characteristics of the constituent note designated as the second chord type ("aug") to thereby change the chord to a new chord (addition: "Am"→"AmM7", or replacement: "Am" →"Aaug"). In the present embodiment, as the first change method, nine chord changing buttons 4A to 4F and 4I to 4K are assigned respectively with second chord types of "m7", "aug", "7", "M7", "6", "9", "O" (dim7), "7sus4", "Φ" (m7♭5).

(b) Second Change Method

In the second change method, when the first chord type corresponds to a third chord type, the first chord type is replaced with a fourth chord type different from the third chord type, and when the first chord type corresponds to the fourth chord type, the first chord type is replaced with the third chord type, whereby the assignment state is changed. The chord designating buttons 3A to 3I are each assigned with the third chord type and fourth chord type to change the assignment state according to the second change method.

Specifically, in the second method, assuming that the chord names indicating the chords to be changed are "C" and "Am" and that "M" and "m" are specified as the third and fourth chord types, respectively, the third chord type and the fourth chord type are replaced with each other to change the chords to new chords ("C"→"Cm" and "Am"→"A"). In the present embodiment, as the second change method, the chord changing button 4H is assigned with a third chord type of "M" and a fourth chord type of "m".

(c) Third Change Method

In the third change method, the assignment state is changed by adding a change symbol (e.g., #, ♭, etc.) to the first root. The chord designating buttons 3A to 3I are assigned respectively with the change symbols to change the assignment state according to the third change method.

Specifically, in the third method, assuming that the chord name indicating the chord to be changed is "C" and that "#" or "♭" is specified as the change symbol, the change symbol is added to the first root to change the chord to a new chord ("C"→"D♯" or "C"→"C♭"). In the present embodiment, as the third change method, a change symbol of "#" is assigned to the chord changing button 4G.

In FIG. 2, for the sake of explanation, the above change methods are labeled to the eleven chord changing buttons 4A to 4K. When the plurality of chord changing buttons 4A to 4K are configured to display a character string, a change method assigned to each of the chord changing buttons 4A to 4K may be displayed in the form of a character string.

The pad group 5 includes a plurality of pads 5A to 5D, which are arranged near a lower surface 23 of the body part 25. The pads 5A to 5D are configured to detect an operation such as playing with a finger strumming guitar strings or an operation such as hitting with a finger. On the casing 2, for example, operators constituted by a keyboard, strings, or the like may be arranged in place of or in addition to the pad group 5.

The menu button 6 is arranged side by side with the chord designating buttons 3A to 3I on the neck part 24. The menu button 6 is formed in a square shape having the same size as each of the chord designating buttons 3A to 3I.

The option button group 7 includes a key up button 70A and a key down button 70B for raising and lowering a key and memory buttons 71A and 71B for reading user setting data (details thereof will be described later) stored in the storage part 12. The option button group 7 is arranged side by side with the display part 9 near the upper surface 22 of the body part 25. The key up button 70A, key down button 70B, and memory buttons 71A and 71B are each formed in a rectangular shape, for example, and are arranged in a two-dimensional or staggered array.

As illustrated in FIG. 1B, operation parts 3 to 7 (chord designating button group 3, chord changing button group 4, pad group 5, menu button 6, option button group 7) are arranged so as to bulge out relative to the surface 20. Each of the operation parts 3 to 7 is formed as, for example, a push button type switch so that it is pushed to substantially the same height as the surface 20 when being operated (depressed) with a player's finger. As a result, a player can easily grasp the operating state and the positional relation of the buttons with the tactile sense of the finger without looking at the hand. Therefore, the operability during a musical performance can be improved.

As the operation parts 3 to 7, any type of sensor may be used as long as it is a sensor capable of detecting the operating state of a player and may be formed as, for example, a pressure sensitive sensor, a contact sensor, a touch panel, or the like. The size, shape, and arrangement state of the operation parts 3 to 7 may be modified as needed.

The sounding part 8 is disposed near the lower surface 23 of the body part 25. The sounding part 8 is constituted by, for example, a sound output device including an amplifier circuit, a speaker, and the like. The sounding part 8 may be an external device such as an external speaker, headphones, or earphones.

The sounding part 8 amplifies a signal based on sounding information (details thereof will be described later) generated by the control part 11 and outputs a sound to the outside through the speaker, thereby emitting a chord sound according to the operation for the chord designating button group 3 and chord changing button group 4.

The display part 9 is disposed side by side with the chord designating button group 3 and chord changing button group 4 near the upper surface 22 of the body part 25. The display part 9 is a display device such as a liquid crystal display, an organic EL display, or a touch panel. The display part 9 displays a performance screen 90A and a user setting screen (details thereof will be described later) illustrated in FIG. 2 based on display information (details thereof will be described later) generated by the control part 11.

As illustrated in FIG. 2, the performance screen 90A includes a plurality of chord images 900A to 900I corresponding to the chords assigned respectively to the chord designating buttons 3A to 3I, a plurality of change method images 901A to 901K corresponding to the change methods assigned respectively to the chord changing buttons 4A to 4K, a menu image 902 corresponding to the menu button 6, and a key image 903 indicating a key set by the key up button 70A and key down button 70B.

Each of the chord images 900A to 900I is an image including a chord name indicating a chord. The change method images 901A to 901F and 901I to 901K corresponding to the first change method are images including the second chord type. The change method image 901H corresponding to the second change method is an image including the third chord type and fourth chord type. The change method image 901G corresponding to the third change method is an image including the change symbol.

The arrangement order of the images (chord images 900A to 900I, change method images 901A to 901K, and menu image 902) on the performance screen 90A coincides with the arrangement order of the buttons (chord designating buttons 3A to 3I, chord changing buttons 4A to 4K, and menu button 6).

Figure 3:
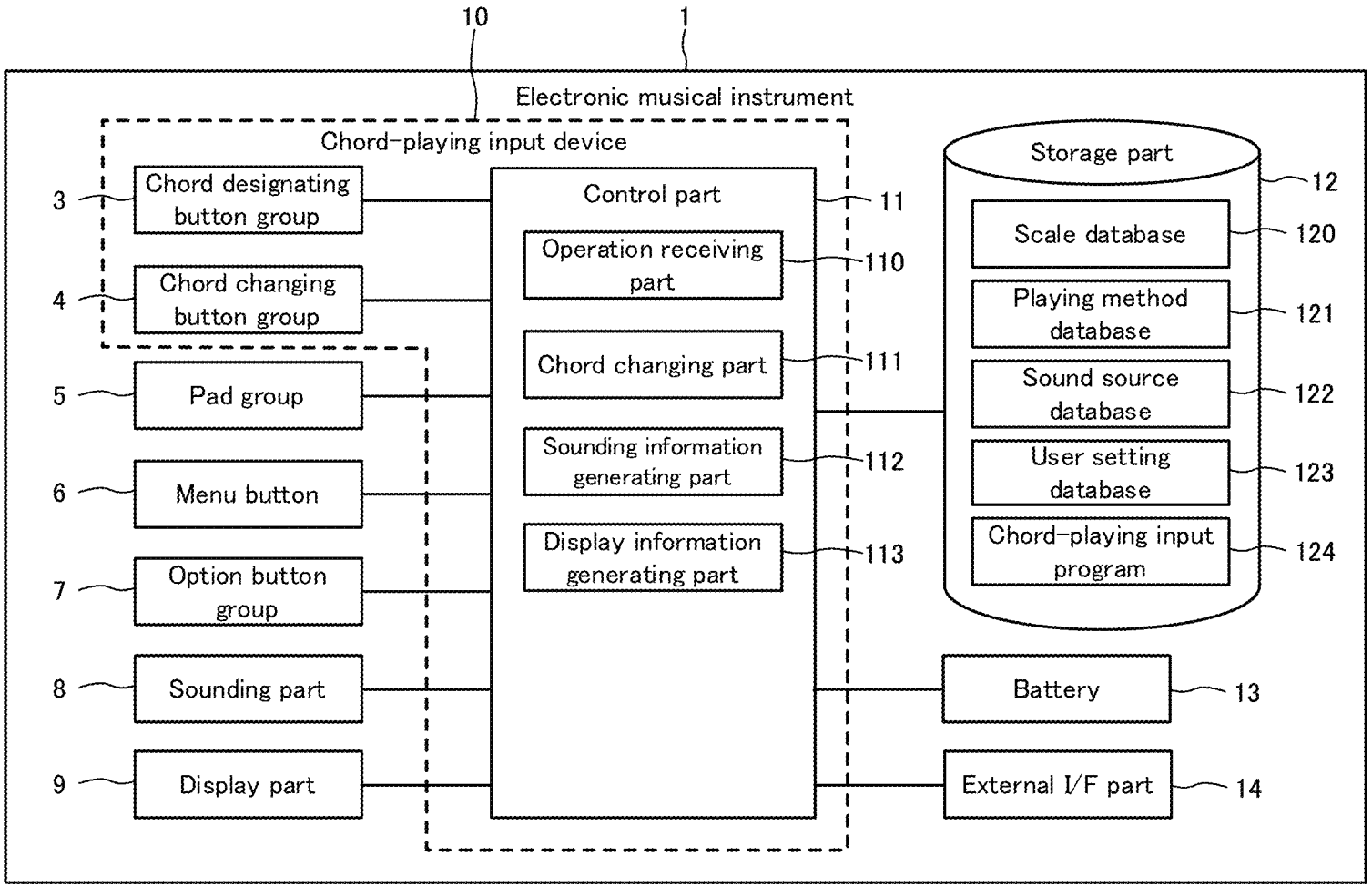
FIG. 3 is a block diagram illustrating an example of the electronic musical instrument 1 and chord-playing input device 10 according to the embodiment of the present invention.
Figure 4:
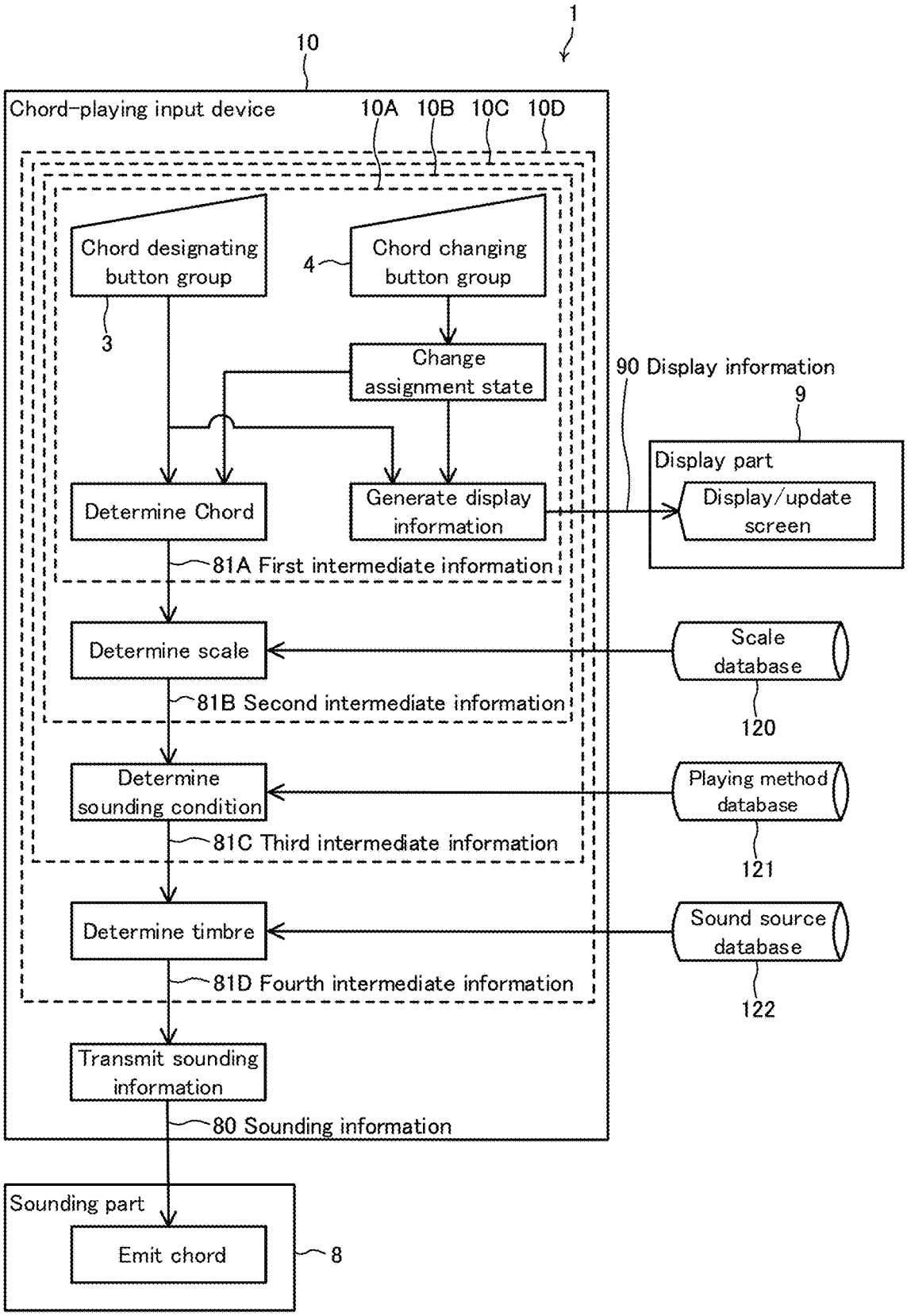
FIG. 4 is a functional explanatory view illustrating an example of the electronic musical instrument 1 and chord-playing input device 10 according to the embodiment of the present invention.

FIG. 3 is a block diagram illustrating an example of the electronic musical instrument 1 and chord-playing input device 10 according to the embodiment of the present invention. FIG. 4 is a functional explanatory view illustrating an example of the electronic musical instrument 1 and chord-playing input device 10 according to the embodiment of the present invention. The chord-playing input device 10 includes at least the chord designating button group 3, chord changing button group 4, and control part 11. In the present embodiment, the chord-playing input device 10 will be described as being specified by the solid line frame (10) depicted in FIG. 4, although it may be specified by the dashed line frames (10A to 10D) depicted in FIG. 4.

The control part 11 is constituted by, for example, an arithmetic processing device such as a CPU, a sound chip, or a video chip. The control part 11 is electrically connected to the operation parts 3 to 7, sounding part 8, display part 9, storage part 12, battery 13, and external I/F part 14.

The storage part 12 is constituted by, for example, a storage device such as an HDD or a memory. The storage part 12 stores a scale database 120, a playing method database 121, a sound source database 122, a user setting database 123, and a chord-playing input program 124 as various data items necessary for playing the electronic musical instrument 1. These data may be updated over a network such as Internet connected with the electronic musical instrument 1.

The scale database 120 is a database for designating the scale corresponding to the constituent notes of a chord by, for example, note numbers. For example, the scale database 120 stores a note number corresponding to each constituent note for each chord.

The playing method database 121 is a database for generating sounding information according to a playing method used in emitting a chord sound. The playing method database 121 stores sounding condition (volume, timing, sound length, etc.) for each playing method such as chord playing, root playing, stroke, and arpeggio.

The sound source database 122 is a database for generating sounding information according to a timbre used in emitting a chord sound. The sound source database 122 stores sound source data for each timbre of a guitar, piano, drum, or the like, for example. As the sound source data, various formats such as an FM sound source, a MIDI sound source, and a PCM sound source are used.

The user setting database 123 is a database for storing various parameters that can be set by a player. The user setting database 123 is composed of a plurality of user setting data and stores parameters such as an assignment state, a key, a playing method, and a timbre for each user setting data. The user setting database 123 is read by the control part 11 in response to operation for the memory buttons 71A and 71B.

The battery 13 is constituted by, for example, a primary battery or a secondary battery. The battery 13 supplies electric power to each part of the electronic musical instrument 1 when a power switch (not illustrated) of the electronic musical instrument 1 is turned on. The electronic musical instrument 1 may be externally supplied with electric power through, for example, an AC adapter or a USB cable.

The external I/F part 14 is constituted by, for example, a communication device and is connected to an external device or a network by wire or wirelessly to transmit and receive information. The external I/F part 14 includes an input/output terminal connected to an external device by wire and a wireless communication part that supports communication standards such as Bluetooth® and wireless LAN.

The control part 11 functions as an operation receiving part 110, a chord changing part 111, a sounding information generating part 112, and a display information generating part 113 by executing a chord-playing input program 124 stored in the storage part 12. The control part 11 receives an operation for the operation parts 3 to 7 and, in response to the operation, controls the sounding part 8, display part 9, and external I/F part 14 while referring to various databases 120 to 123 stored in the storage part 12.

The operation receiving part 110 receives an operation for each of the operation parts 3 to 7.

When the operation receiving part 110 receives an operation for one of the chord changing buttons 4A to 4K, the chord changing part 111 changes the assignment state according to the change method assigned to the operated chord changing button. The chord changing part 111 maintains the thus changed assignment state while the chord changing button is being operated and returns this chord assignment state to the original assignment state when the operation for the chord changing button is released. The chord changing part 111 may return the assignment state to the original assignment state when another operation for one of the chord changing buttons 4A to 4K is received, not when the operation for the chord changing button is canceled.

When the operation receiving part 110 receives an operation for any of the chord designating and changing buttons 3A to 3I and 4A to 4K, the sounding information generating part 112 generates sounding information 80 for making the sounding part 8 emit a chord sound corresponding to the operation. The sounding information 80 only needs to include information indicating the chords to be emitted as a sound by the sounding part 8, and the data format and contents thereof are not particularly limited. Further, the sounding information generating part 112 may include the chord changing part 111 as a part of its function.

When the operation for one of the chord designating buttons 3A to 3I is received, the sounding information generating part 112 generates the sounding information 80 based on the chord assigned to the operated chord designating button. In the present embodiment, the sounding information generating part 112 generates the sounding information 80 for making the sounding part 8 continuously emit a chord sound corresponding to the operation during a time from when the operation is received until it is released.

Further, when the operation receiving part 110 receives a simultaneous operation for one of the chord designating buttons 3A to 3I and one of the chord changing buttons 4A to 4K, the sounding information generating part 112 generates the sounding information 80 based on not the chord originally assigned to the chord designating button but the chord newly assigned thereto by the chord changing part 111 changing the assignment state according to a change method assigned to the chord changing button. The simultaneous operation includes not only when the chord designating and changing buttons are operated simultaneously, but also when the chord designating button is operated in a state where the chord changing button is operated and when the chord changing button is operated in a state where the chord designating button is operated.

Specific processing when the sounding information generating part 112 generates the sounding information 80 is as illustrated in FIG. 4. That is, when the operation for any of the chord designating and changing buttons 3A to 3I and 4A to 4K is received, the sounding information generating part 112 identifies a chord corresponding to the operation, by referring to, for example, a chord name (first intermediate information 81A) to determine the chord to be emitted as a sound by the sounding part 8. The sounding information generating part 112 refers to the scale database 120 based on the chord name indicated by the first intermediate information 81A to determine a scale (second intermediate information 81B) corresponding to the constituent notes of the chord. The sounding information generating part 112 refers to the playing method database 121 to determine a sounding condition (third intermediate information 81C=scale+sounding condition) for emitting a chord sound. The sounding information generating part 112 refers to the sound source database 122 to determine a timbre (fourth intermediate information 81D=scale+sounding condition+timbre) for emitting a chord sound. Then, based on the fourth intermediate information 81D (scale+sounding condition+timbre), the sounding information generating part 112 generates the sounding information 80 for making the sounding part 8 emit a sound under the sounding condition and with the timbre and transmits the generated sounding information 80 to the sounding part 8.

The display information generating part 113 generates, in response to the operation received by the operation receiving part 110, display information 90 for making the display part 9 display the performance screen 90A and user setting screen (details thereof will be described later). The display information 90 only needs to include information indicating a screen or an image to be displayed on the display part 9, and the format and contents of the data are not particularly limited. Further, the display information generating part 113 may include the chord changing part 111 as a part of its function.

(Operation of Electronic Musical Instrument 1 and Chord-Playing Input Device 10)

Next, the operation of the electronic musical instrument 1 and chord-playing input device 10 having the above configurations will be described. Here, description will be made assuming that the power switch (not illustrated) is turned on, and power is supplied from the battery 13 to each part of the electronic musical instrument 1, so that the display part 9 displays the performance screen 90A illustrated in FIG. 2 as the initial screen.

(1) When Menu Button 6 is Operated

Figure 5:
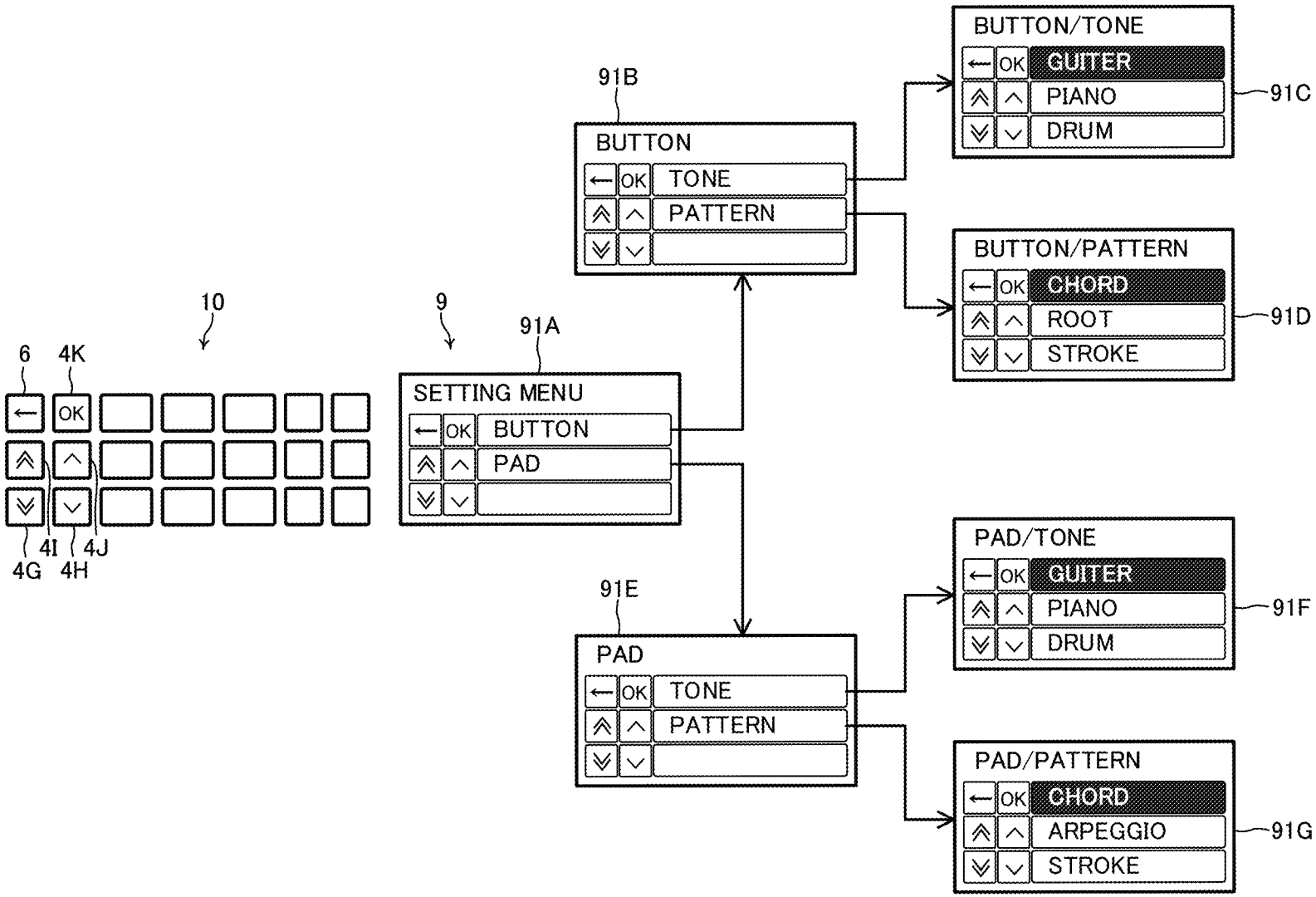
FIG. 5 is a view illustrating user setting screens 91A to 91G when the menu button 6 is operated.

FIG. 5 is a view illustrating user setting screens 91A to 91G when the menu button 6 is operated.

When the menu button 6 is operated by a player, the operation receiving part 110 receives the operation, and the display information generating part 113 generates the display information 90 for making the display part 9 display the user setting screens 91A to 91G illustrated in FIG. 5. When, for example, five chord changing buttons 4G to 4K and the menu button 6 are operated in a state where the user setting screens 91A to 91G are displayed, determination (OK), return, cursor up/down movement, page up/down movement may be performed. The user setting data set on the user setting screens 91A to 91G are stored in the user setting database 123.

On the user setting screen 91A, when "BUTTON" is selected, the user setting screens 91B to 91D for the chord designating button group 3 are displayed, and when "PAD" is selected, the user setting screens 91E to 91G for the pad group 5 are displayed.

The user setting screens 91B to 91D are configured to set "TONE" (timbre) and "PATTERN" (playing method) of the chords emitted as a sound by the sounding part 8 when the chord designating button group 3 is operated. On the user setting screen 91C, the "TONE" is set from among options of a plurality of types of musical instruments (guitar, piano, drum, etc.). On the user setting screen 91D, the "PATTERN" is set from among three options of "CHORD", "ROOT", and "STROKE". The "CHORD" is an option for simultaneously emitting the constituent notes of a chord. The "ROOT" is an option for simultaneously emitting the root note of a chord and the note one octave above it. The "STROKE" is an option for emitting the constituent notes of a chord in order, like the stroke playing method for guitar.

The user setting screens 91E to 91G are configured to set the "TONE" (timbre) and "PATTERN" (playing method) of the chords emitted by the sounding part 8 when the pad group 5 is operated. On the user setting screen 91F, the "TONE" is set from among a plurality of types of musical instruments (guitar, piano, drum, etc.). On the user setting screen 91G, the "PATTERN" is set from among three options of "CHORD", "ARPEGGIO", and "STROKE". The "CHORD" is an option for simultaneously emitting constituent notes of a chord assigned respectively to pads 5A to 5D The "ARPEGGIO" is an option for emitting one or two constituent notes of a chord for each of the pads 5A to 5D. The "STROKE" is an option for emitting chords by the upper stroke with the first pad 5A and by the down stroke with the second pad 5B.

(2) When Key Up Button 70A or Key Down Button 70B is Operated

Figure 6:
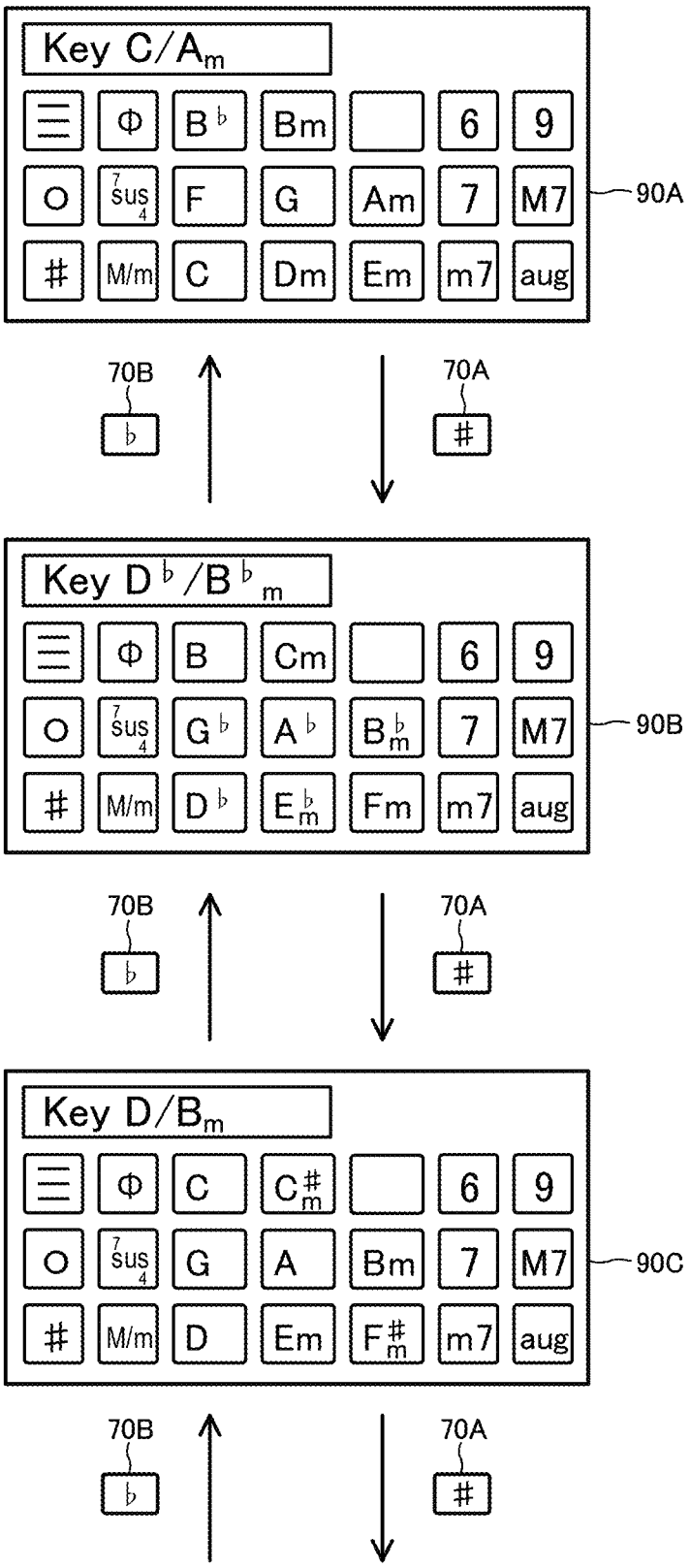
FIG. 6 is a view illustrating performance screens 90A to 90C when a key up button 70A or a key down button 70B is operated.

FIG. 6 is a view illustrating performance screens 90A to 90C when the key up button 70A or key down button 70B is operated.

When the key up button 70A or key down button 70B is operated by a player, the operation receiving part 110 receives the operation, and the chord changing part 111 changes the assignment state by raising or lowering the key of the chords assigned respectively to the chord designating buttons 3A to 3I by a semitone. As a result, even if the key of a musical piece is changed, the arrangement relation concerning the pitch of the first root constituting each chord does not change, so that the player can play with the same fingering.

At this time, the display information generating part 113 generates the display information 90 based on the chord images 900A to 900I corresponding to the chords after the changing of the assignment state by the chord changing part 111 and key image 903 displayed as the result of the operation for the key up button 70A or key down button 70B. As a result, the display part 9 displays the performance screen 90A indicating "C major/B minor", performance screen 90B indicating "D flat major/B flat minor", and performance screen 90C indicating "D major/B minor" according to the operation for the key up button 70A or the key down button 70B in a switching manner.

(3) When the Chord Designating Button Group 3 is Operated

Figure 7:
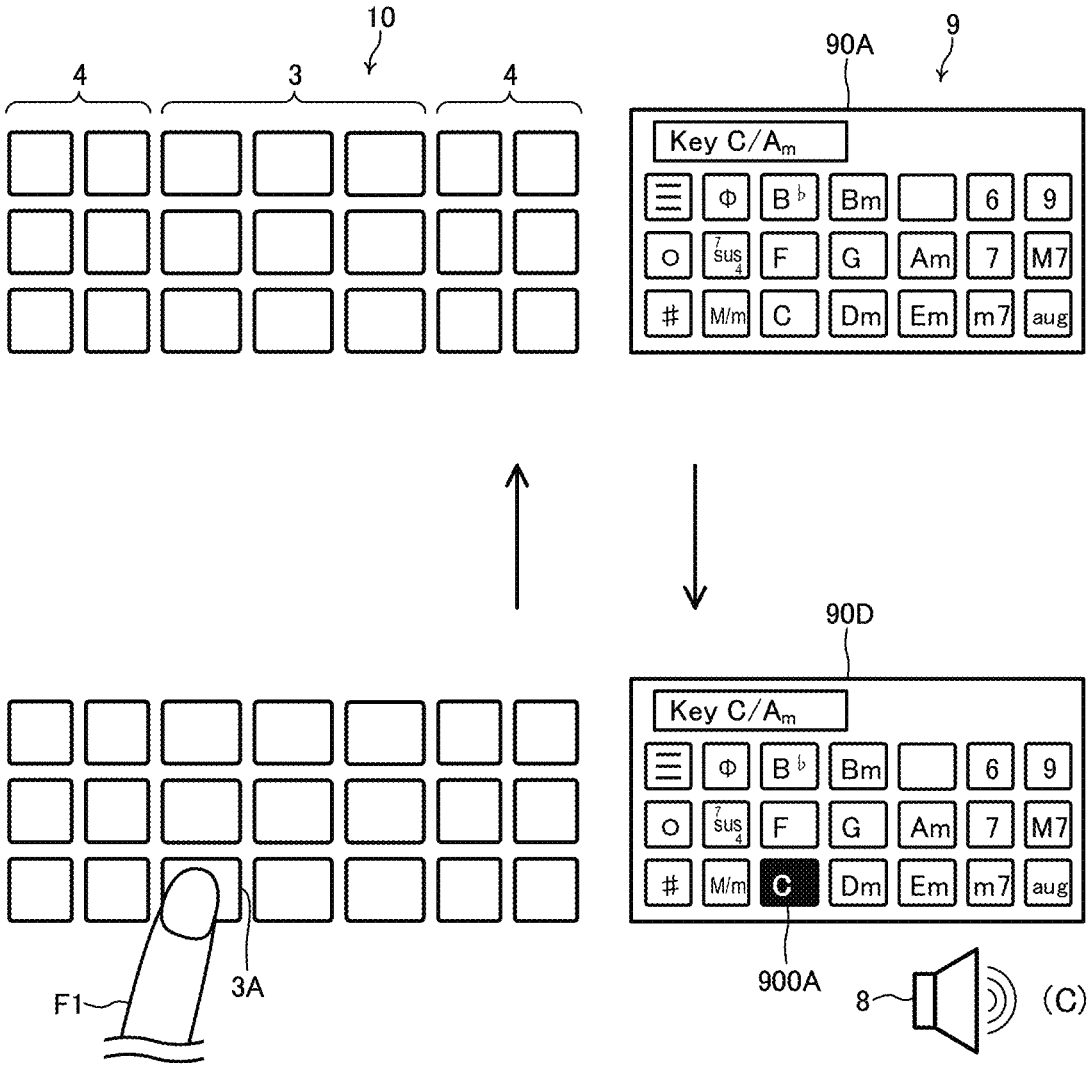
FIG. 7 is a view illustrating performance screens 90A and 90D when a chord designating button 3A is operated.

FIG. 7 is a view illustrating the performance screens 90A and 90D when the chord designating button 3A is operated.

When a player operates one of the chord designating buttons 3A to 3I in a state where the performance screen 90A illustrated in FIG. 7 is displayed on the display part 9, the operation receiving part 110 receives the operation. Here, a case where the player operates the chord designating button 3A assigned with the chord "C" as the initial assignment state with a finger F1 will be described.

When the operation receiving part 110 receives an operation for the chord designating button 3A, the sounding information generating part 112 generates the sounding information 80 for making the sounding part 8 emit the sound of the chord "C" assigned to the chord designating button 3A. That is, the sounding information generating part 112 refers to the scale database 120 to determine the scale corresponding to the plurality of constituent notes constituting the chord "C". Then, the sounding information generating part 112 reads out the sounding condition and sound source data from the playing method database 121 and sound source database 122 based on the playing method and timbre set in the menu of the "BUTTON" on the user setting screen 91A to generate the sounding information 80. The sounding part 8 emits the sound of the chord "C" based on the generated sounding information 80.

At this time, the display information generating part 113 generates the display information 90 in which the display mode of the chord image 900A corresponding to the chord "C" assigned to the chord designating button 3A has been changed (for example, the colors of the character and background are inverted). The display part 9 displays the performance screen 90D illustrated in FIG. 7 based on the generated display information 90.

When the operation for the chord designating button 3A is cancelled, the display information generating part 113 generates the display information 90 in which the display mode of the chord image 900A has been returned to the original display mode. As a result, the display part 9 displays the performance screen 90A before the chord designating button 3A is operated.

When the operation receiving part 110 receives an operation for the pad group 5 in a state where the chord designating button 3A is operated, the sounding information generating part 112 refers to the scale database 120 to determine the scale corresponding to the constituent notes of the chord "C". Then, the sounding information generating part 112 reads out the sounding condition and sound source data from the playing method database 121 and sound source database 122 based on the playing method and timbre set in the menu of the "PAD" on the user setting screen 91A to generate the sounding information 80.

As described above, on the performance screen 90D, the display mode of the chord image 900A is changed according to the operation for the chord designating button 3A, so that a player can easily grasp a chord name indicating the currently emitted sound of the chord "C". In addition, a player can easily grasp the relative positional relation between the position of the chord designating button 3A currently being operated and the other buttons (cord designating buttons 3B to 3I and chord changing buttons 4A to 4K) than the chord designating button 3A. Thus, for example, when the chord to be played next to the chord "C" is "Dm", a player can grasp in advance that the chord "Dm" can be output by operating the chord designating button 3B adjacent to the right side of the chord designating button 3A currently being operated with the finger F1 or another finger. Thus, according to the electronic musical instrument 1 and chord-playing input device 10 according to the embodiment of the present invention, the operability during a musical performance can be improved.

Figure 8:
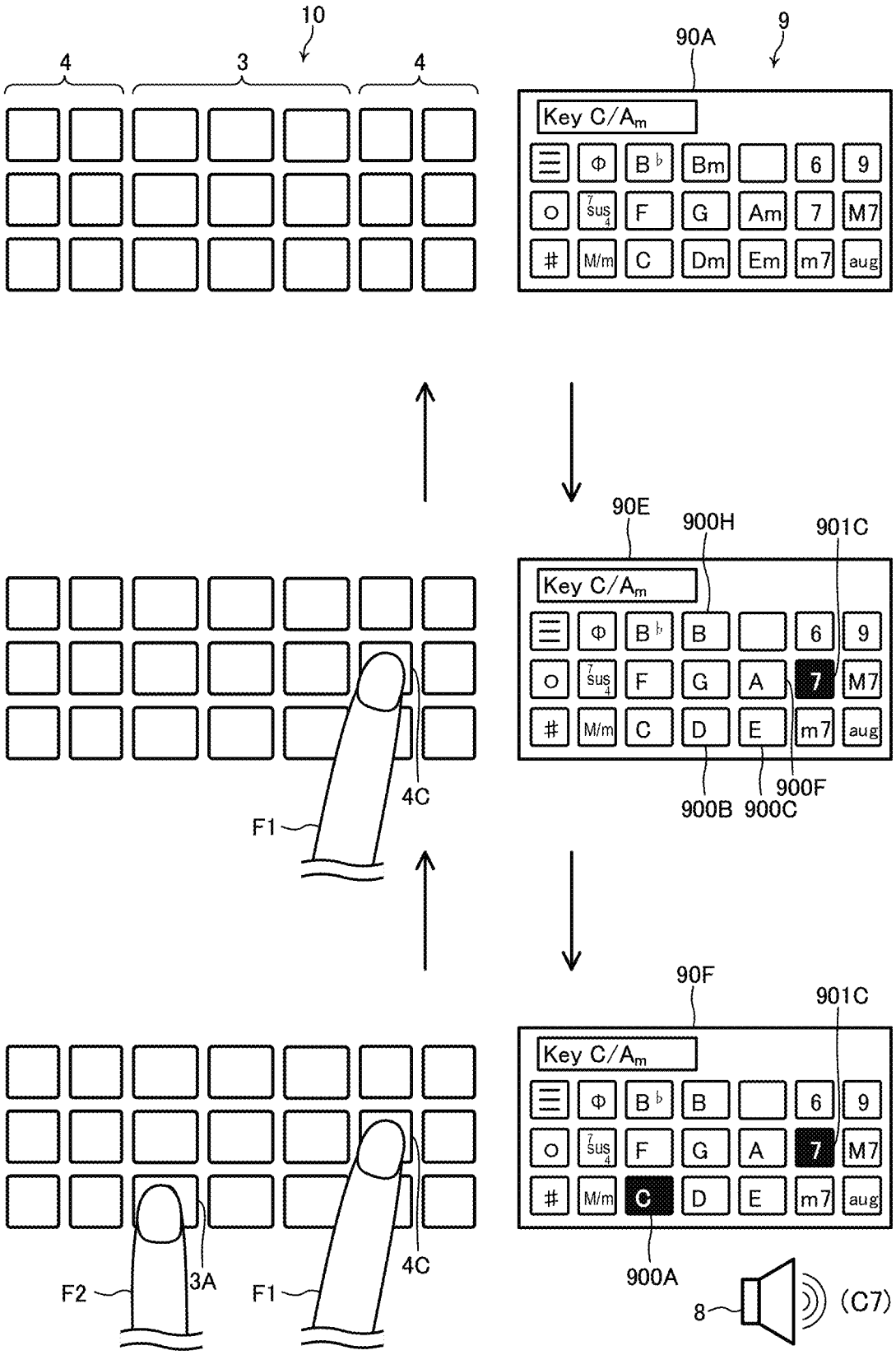
FIG. 8 is a view illustrating performance screens 90A, 90E, and 90F when a chord changing button 4C assigned with a first change method is operated.
Figure 9:
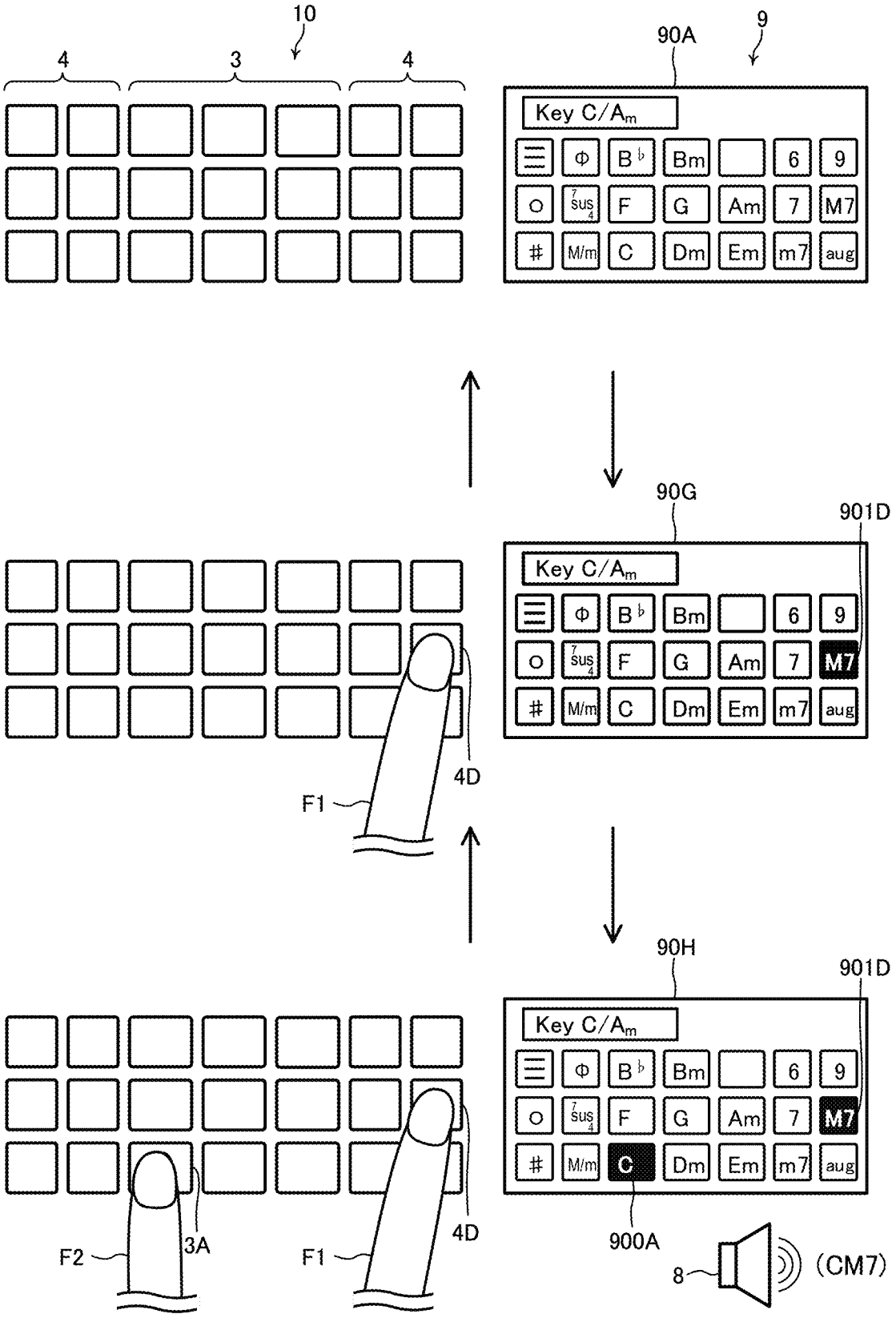
FIG. 9 is a view illustrating performance screens 90A, 90G, and 90H when a chord changing button 4D assigned with the first change method is operated.

(4) When the Chord Designating Button Group 3 and Chord Changing Button Group 4 are Operated (4.a) The First Change Method FIG. 8 is a view illustrating the performance screens 90A, 90E, and 90F when the chord changing button 4C assigned with the first change method is operated. FIG. 9 is a view illustrating the performance screens 90A, 90G, and 90H when the chord changing button 4D assigned with the first change method is operated.

When a player operates one of the chord changing buttons 4A to 4K in a state where the performance screen 90A is displayed on the display part 9, the operation receiving part 110 receives the operation.

First, when the operation receiving part 110 receives an operation for the chord changing button 4C by the finger F1 in a state where the performance screen 90A illustrated in FIG. 8 is displayed on the display part 9, the chord changing part 111 changes the assignment state according to the first change method (second chord type "7") assigned to the chord changing button 4C. That is, the chord changing part 111 changes the assignment state by replacing the first chord type ("M" or "m") constituting each chord assigned to each of the chord designating buttons 3A to 3I with the second chord type "7".

At this time, the display information generating part 113 generates the display information 90 in which the display mode of the change method image 901C corresponding to the first change method (second chord type "7") has been changed (for example, the colors of the character and background are inverted). Further, the display information generating part 113 generates the display information 90 in which the notation of "m" (minor), which becomes unnecessary by the chord changing part 111 changing the assignment state according to the first change method (second chord type "7"), has been removed from the code names included respectively in the chord images 900B, 900C, 900F, and 900H. The display part 9 displays the performance screen 90E illustrated in FIG. 8 based on the generated display information 90.

Then, when the operation receiving part 110 receives an operation for the chord designating button 3A by the finger F2 in a state where the performance screen 90E is displayed, that is, in a state where the chord changing button 4C is operated, the sounding information generating part 112 generates the sounding information 80 based on not the chord "C" originally assigned to the chord designating button 3A, but the chord "C7" which is newly assigned thereto by the chord changing part 111 changing the assignment state as above. The sounding part 8 emits the sound of the chord "C7" based on the generated sounding information 80.

At this time, the display information generating part 113 generates the display information 90 in which the display mode of the chord image 900A corresponding to the chord designating button 3A has been changed (for example, the colors of the character and background are inverted). The display part 9 displays the performance screen 90F illustrated in FIG. 8 based on the generated display information 90.

Further, when the operation for the chord changing button 4C is cancelled in a state where the performance screen 90E is displayed, the chord changing part 111 returns the changed assignment state to the original assignment state (initial assignment state). Then, the display information generating part 113 generates the display information 90 based on the chord images 900A to 900I corresponding to the original assignment state and change method image 901C in the original display mode. As a result, the display part 9 displays the performance screen 90A before the chord changing button 4C is operated.

Further, when the operation for the chord designating button 3A is cancelled in a state where the performance screen 90F is displayed, the display information generating part 113 generates the display information 90 based on the chord image 900A whose display mode has been returned to the original display mode. As a result, the display part 9 displays the performance screen 90E before the chord designating button 3A is operated.

When the second chord type in the first change method is "m7", "aug", "O", "7sus4", or "Φ" in addition to the above "7", the display part 9 removes the notation of "m" (minor) from the chord names included respectively in the chord images 900A to 900I as illustrated in FIG. 8 and displays the resultant chord images 900A to 900I.

Next, when the operation receiving part 110 receives an operation for the chord changing button 4D by the finger F1 in a state where the performance screen 90A illustrated in FIG. 9 is displayed on the display part 9, the chord changing part 111 changes the assignment state according to the first change method (second chord type "M7") assigned to the chord changing button 4D. That is, the chord changing part 111 changes the assignment state by adding the second chord type "M7" to the first chord type ("M" or "m") that constitutes each chord assigned to each of chord designating buttons 3A to 3I.

At this time, the display information generating part 113 generates the display information 90 in which the display mode of the change method image 901D corresponding to the first change method (second chord type "M7") has been changed (for example, the colors of the character and background have been inverted). The display part 9 displays the performance screen 90G illustrated in FIG. 9 based on the generated display information. Here, the display information generating part 113 does not generate the display information 90 in which the notation of "m" (minor) has been removed from the code names included respectively in the chord images 900A to 900I.

Then, when the operation receiving part 110 receives an operation for the chord designating button 3A by the finger F2 in a state where the performance screen 90G is displayed, that is, in a state where the chord changing button 4D is operated, the sounding information generating part 112 generates the sounding information 80 based on not the chord "C" originally assigned to the chord designating button 3A, but the chord "CM7" which is newly assigned thereto by the chord changing part 111 changing the assignment state as above. The sounding part 8 emits the chord "CM7" based on the generated sounding information 80.

At this time, like the case illustrated in FIG. 8, the display information generating part 113 generates the display information 90, and the display part 9 displays the performance screen 90H illustrated in FIG. 9. The operation when the operation for the chord changing button 4D is cancelled on the performance screen 90G and the operation when the operation for the chord designating button 3A is cancelled on the performance screen 90H are the same as those in FIG. 8, so the descriptions thereof will be omitted.

When the second chord type in the first change method is "6" or "9" in addition to the above "M7", the display part 9 displays the chord images 900A to 900I without removing the notation of "m" (minor) from the chord names included respectively in the chord images 900A to 900I as illustrated in FIG. 9.

(4.b) Second Change Method

Figure 10:
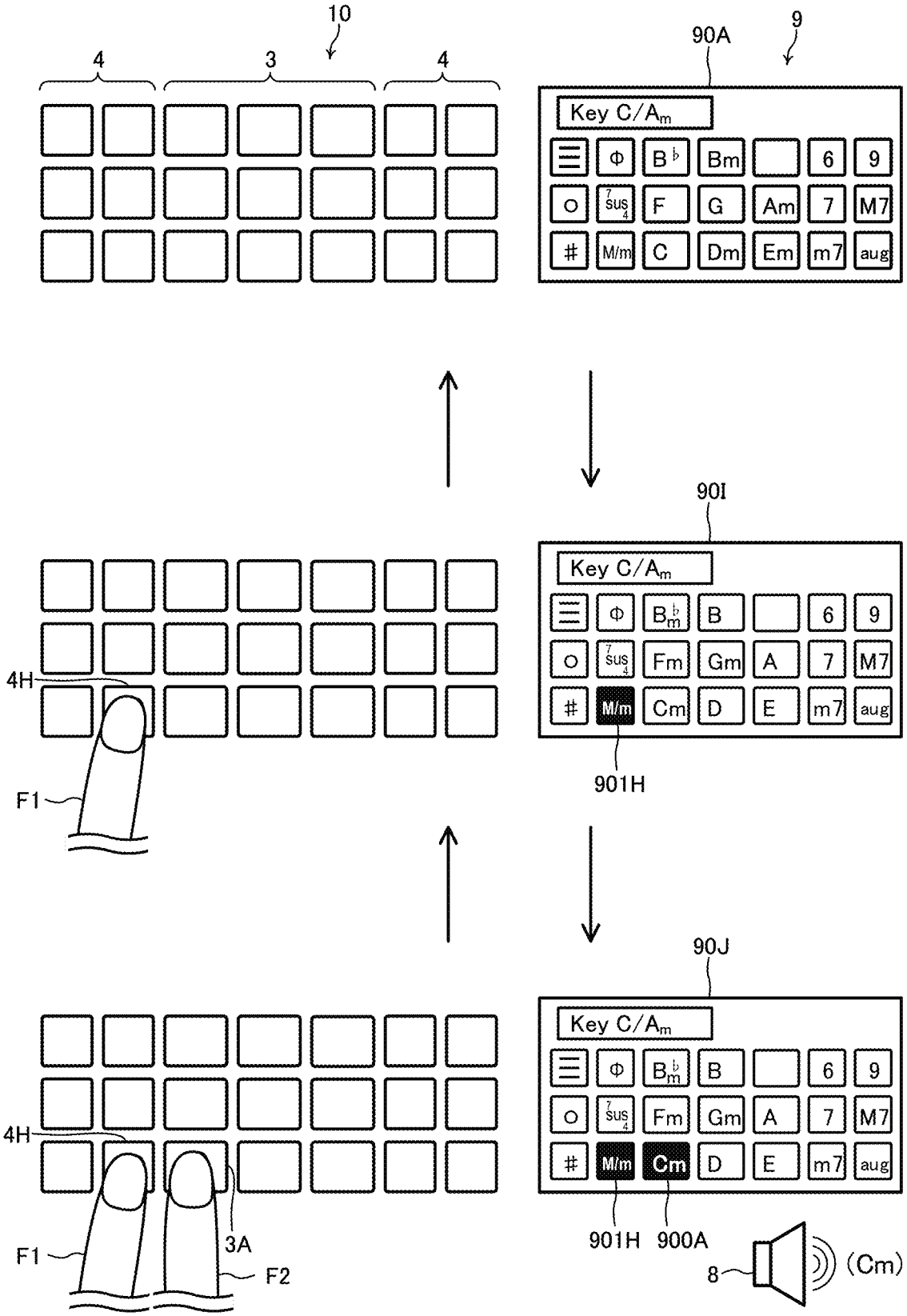
FIG. 10 is a view illustrating performance screens 90A, 90I, and 90J when a chord changing button 4H assigned with a second change method is operated.

FIG. 10 is a view illustrating the performance screens 90A, 90I, and 90J when the chord changing button 4H assigned with the second change method is operated.

When the operation receiving part 110 receives an operation for the chord changing button 4H by the finger F1 in a state where the performance screen 90A illustrated in FIG. 10 is displayed on the display part 9, the chord changing part 111 changes the assignment state according to the second change method (third chord type "M" and fourth chord type "m") assigned to the chord changing button 4H. That is, the chord changing part 111 changes the first chord type constituting each chord assigned to each of the chord designating buttons 3A to 3I from the major to minor, and vice versa to thereby change the assignment state.

At this time, the display information generating part 113 generates the display information 90 in which the display mode of the change method image 901H corresponding to the second change method (the third chord type "M" and fourth chord type "m") has been changed (for example, the colors of the character and background have been inverted). Further, the display information generating part 113 generates the display information 90 based on the chord images 900A to 900I corresponding to the chords each of whose assignment states is changed (the major and minor are replaced with each other) by the chord changing part 111 according to the second change method (the third chord type "M" and fourth chord type "m"). The display part 9 displays the performance screen 90I illustrated in FIG. 10 based on the generated display information 90.

Then, when the operation receiving part 110 receives an operation for the chord designating button 3A by the finger F2 in a state where the performance screen 90I is displayed, that is, in a state where the chord changing button 4H is operated, the sounding information generating part 112 generates the sounding information 80 based on not the chord "C" originally assigned to the chord designating button 3A, but the chord "Cm" which is newly assigned thereto by the chord changing part 111 changing the assignment state as above. The sounding part 8 emits the sound of the chord "Cm" based on the generated sounding information 80.

At this time, like the case illustrated in FIG. 8, the display information generating part 113 generates the display information 90, and the display part 9 displays the performance screen 90J illustrated in FIG. 10. The operation when the operation for the chord changing button 4H is released on the performance screen 90I and the operation when the operation for the chord designating button 3A is released on the performance screen 90J are the same as those in FIG. 8, so the descriptions thereof will be omitted.

(4.c) Third Change Method

Figure 11:
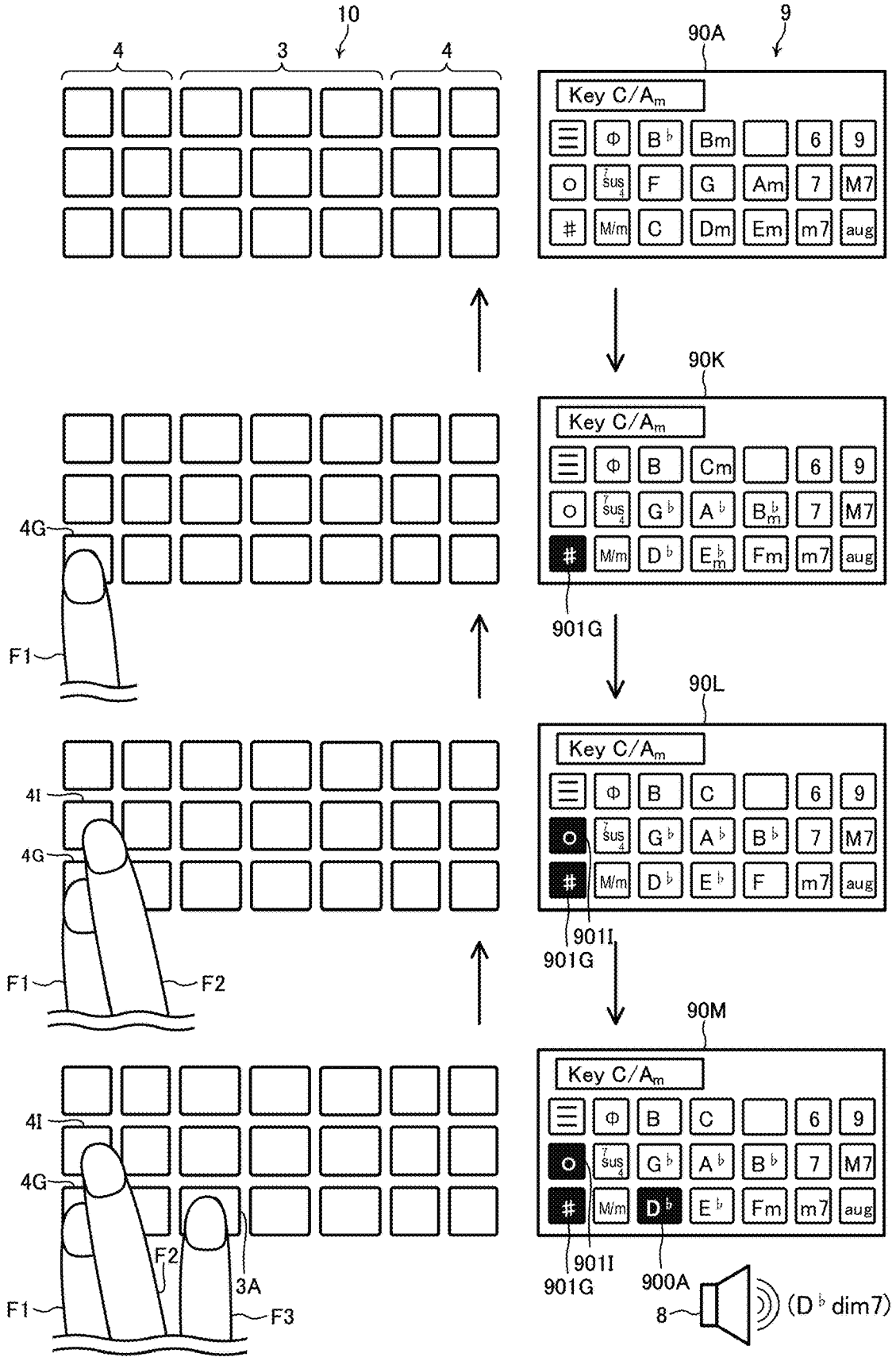
FIG. 11 is a view illustrating performance screens 90A and 90K to 90M when a chord changing button 4G assigned with a third change method is operated.

FIG. 11 is a view illustrating performance screens 90A and 90K to 90M when the chord changing button 4G assigned with the third change method is operated.

When the operation receiving part 110 receives an operation for the chord changing button 4G by the finger F1 in a state where the performance screen 90A illustrated in FIG. 11 is displayed on the display part 9, the chord changing part 111 changes the assignment state according to the third change method (change symbol "#") assigned to the chord changing button 4G. That is, the chord changing part 111 changes the assignment state by raising the first root constituting each chord assigned to each of the chord designating buttons 3A to 3I by a semitone.

At this time, the display information generating part 113 generates the display information 90 in which the display mode of the change method image 901H corresponding to the third change method (change symbol "#") has been changed (for example, the colors of the character and background have been inverted). Further, the display information generating part 113 generates the display information 90 based on the chord images 900A to 900I corresponding to the chords each of whose assignment states have been changed (the key thereof has been raised by a semitone) by the chord changing part 111 according to the third change method (change symbol "#"). The display part 9 displays the performance screen 90K illustrated in FIG. 11 based on the generated display information 90.

Then, when the operation receiving part 110 receives an operation for the chord changing button 4I by the finger F2 in a state where the performance screen 90K is displayed, that is, in a state where the chord changing button 4G is operated, the sounding information generating part 112 changes the assignment state according to the first change method (second chord type "O") assigned to the chord changing button 4I.

At this time, the display information generating part 113 generates the display information 90 in which the display mode of the change method image 901I corresponding to the first change method (second chord type "O") has been changed (for example, the colors of the character and background have been inverted). The display part 9 displays the performance screen 90L illustrated in FIG. 11 based on the generated display information 90.

Then, when the operation receiving part 110 receives an operation for the chord designating button 3A by the finger F3 in a state where the performance screen 90L is displayed, that is, in a state where the chord changing buttons 4G and 4I are operated, the sounding information generating part 112 generates the sounding information 80 based on not the chord "C" originally assigned to the chord designating button 3A, but the chord "D♭dim7" which is newly assigned thereto by the chord changing part 111 changing the assignment state as above. The sounding part 8 emits the sound of the chord "D♭dim7" based on the generated sounding information 80.

At this time, like the case illustrated in FIG. 8, the display information generating part 113 generates the display information 90, and the display part 9 displays the performance screen 90M illustrated in FIG. 11. The operation when the operation for the chord changing button 4G is cancelled on the performance screen 90K and the operation when the operation for the chord changing button 4I is cancelled on the performance screen 90L are the same as those in FIG. 8, so the descriptions thereof will be omitted.

As described above, when the chord changing buttons 4C and 4D assigned with the first change method (second chord type "7" or "M7") are operated, the chord changing part 111 changes the chord "C" assigned to the chord designating button 3A as the initial assignment state to the chord "C7" or "CM7" based on the second chord type "7" or "M7". Further, when the chord changing button 4H assigned with the second change method (third chord type "M" and fourth chord type "m") is operated, the chord changing part 111 changes the chord "C" to the chord "Cm" based on the third chord type "M" and fourth chord type "m". Further, when the chord changing button 4G assigned with the third change method (change symbol "#") is operated, and the chord changing button 4I assigned with the first change method (second chord type "O") is operated, the chord changing part 111 changes the chord "C" to the chord "D♭dim7" based on the change symbol "#" and second chord type "O".

That is, the sounding information generating part 112 generates the sounding information 80 for making the sounding part 8 emit a chord corresponding to a combination of any of the operated chord designating and changing buttons 3A to 3I and 4A to 4K. At this time, the chord assignment state for the chord designating buttons 3A to 3I is changed according to the change methods assigned to the chord changing buttons 4A to 4K, so that the number of chords that can be played is determined according to the number of chord designating buttons 3A to 3I and the number of chord changing buttons 4A to 4K. Thus, according to the electronic musical instrument 1 and chord-playing input device 10 of the embodiment of the present invention, it is possible to generate a larger number of types of chords that can be played than the number of the chord designating buttons 3A to 3I.

Further, as the performance screens 90A, 90E through 90M show in FIGS. 8 to 11, the display information generating part 113 generates the display information 90 for making the display part 9 display the chord images 900A to 900I and change method images 901A to 901K in the same arrangement order as those of the chord designating buttons 3A to 3I and chord changing buttons 4A to 4K before and after the assignment state is changed by the chord changing part 111. Thus, a player can easily grasp the arrangement state of the chord designating buttons 3A to 3I and chord changing buttons 4A to 4K, as well as the chord currently emitted as a sound when each button is operated (including a chord after the assignment state has been changed). Therefore, according to the electronic musical instrument 1 and chord-playing input device 10 of the embodiment of the present invention, the operability during a musical performance can be improved.

Further, on the performance screens 90E to 90M, the display modes of the chord images 900A to 900I and change method images 901A to 901K are changed according to the operations for the chord designating buttons 3A to 3I and chord changing buttons 4A to 4K. Thus, for example, a player can easily grasp the chord name indicating the chord currently being emitted (including the chord after the change), so that the operability during a musical performance can be improved.

Further, when the chord designating button 3A assigned with the chord "C" as the initial assignment state and the chord changing button 4C assigned with the second chord type "7" as the first change method are operated simultaneously, the sounding information generating part 112 generates the sounding information 80 based on not the chord "C" originally assigned to the chord designating button 3A, but the chord "C7" which is newly assigned thereto by the chord changing part 111 changing the assignment state according to the first change method. Thus, a player can easily designate a different chord by operating the chord designating button 3A and chord changing button 4C simultaneously, so that the operability during a musical performance can be improved.

Further, the chord designating buttons 3A to 3I and chord changing buttons 4A to 4K are arranged side by side within a range operable with one hand. Thus, the performer can designate a plurality of chords with one or a plurality of fingers of one hand, so that the operability during a musical performance can be improved.

Further, the chord designating buttons 3A to 3I are arranged as the chord designating button group 3 in a two-dimensional or staggered array, and the chord changing buttons 4A to 4K are arranged adjacent to the chord designating button group 3. Thus, a player can quickly move the finger even to the plural chord changing buttons 4A to 4K while placing the finger above the chord designating button group 3. Thus, the player can efficiently operate the plural chord designating buttons 3A to 3I and chord changing buttons 4A to 4K, so that the operability during a musical performance can be improved.

OTHER EMBODIMENTS

While the embodiment of the present invention has been described above, the present invention is not limited to the above embodiment and can be appropriately modified without departing from the technical idea of the present invention.

Figures 12A, 12B, 12C:
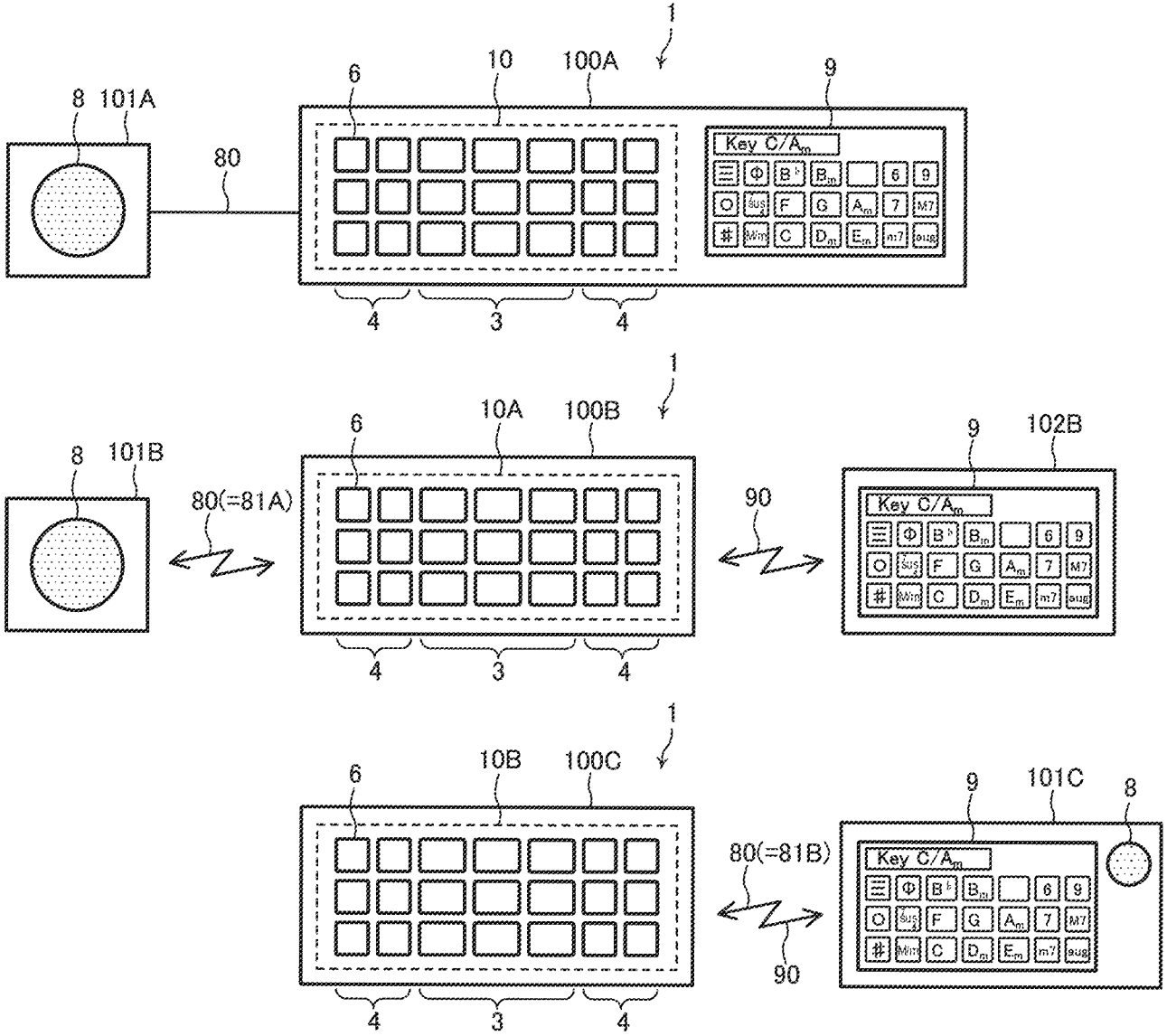
FIGS. 12A to 12C illustrate, respectively, first to third configuration examples of the electronic musical instrument 1 and chord-playing input device 10 according to another embodiment of the present invention.

For example, in the above embodiment, the electronic musical instrument 1 has the chord-playing input device 10, sounding part 8, and display part 9; however, as illustrated in FIGS. 12A to 12C, a plurality of devices may separately include these components and be mutually connected by wire or wirelessly to function as the electronic musical instrument 1. Further, the chord-playing input device 10 may be specified by any one of the dashed line frames 10A to 10D illustrated in FIG. 4, and in that case, the sounding information generating part 112 may generate any one of the first to fourth intermediate information 81A to 81D as the sounding information 80 and transmit it to another device.

FIGS. 12A to 12C illustrate, respectively, first to third configuration examples of the electronic musical instrument 1 and chord-playing input device 10 according to another embodiment of the present invention.

In the first configuration example illustrated in FIG. 12A, a first device 100A includes the chord-playing input device 10 and display part 9, and a second device 101A includes the sounding part 8. The sounding information 80 generated by the sounding information generating part 112 of the chord-playing input device 10 is transmitted to the second device 101A and emitted as a sound by the sounding part 8 of the second device 101A. The display information 90 generated by the display information generating part 113 of the chord-playing input device 10 is displayed by the display part 9 of the first device 100A.

In the second configuration example illustrated in FIG. 12B, a first device 100B includes a chord-playing input device 10A (specified by the dashed line frame 10A illustrated in FIG. 4), a second device 101B includes the sounding part 8, and a third device 102B includes the display part 9. The sounding information 80 (the first intermediate information 81A illustrated in FIG. 4) generated by the sounding information generating part 112 of the chord-playing input device 10A is transmitted to the second device 101B and emitted as a sound by the sounding part 8 of the second device 101B. The display information 90 generated by the display information generating part 113 of the chord-playing input device 10A is transmitted to the third device 102B and displayed by the display part 9 of the third device 102B.

In the third configuration example illustrated in FIG. 12C, a first device 100C includes a chord-playing input device 10B (specified by the dashed line frame 10B illustrated in FIG. 4), and a second device 101C includes the sounding part 8 and display part 9. The sounding information 80 (the second intermediate information 81B illustrated in FIG. 4) generated by the sounding information generating part 112 of the chord-playing input device 10B is transmitted to the second device 101C and emitted as a sound by the sounding part 8 of the second device 101C. The display information 90 generated by the display information generating part 113 of the chord-playing input device 10B is transmitted to the second device 101C and displayed by the display part 9 of the second device 101C.

Further, in the above embodiment, the chord designating buttons 3A to 3I are assigned with a plurality of chords with the assignment state illustrated in FIG. 2 being as the initial assignment state; however, the initial assignment state may be configured to be changeable by a player. Further, the assignment state in which a plurality of change methods are assigned respectively to the chord changing buttons 4A to 4K may also be configured to be changeable by a player.

In this case, it may be configured that the assignment state changed by a performer is stored in the user setting database 123 as user setting data, and the control part 11 reads the user setting data from the user setting database 123 in response to the operation for the memory buttons 71A and 71B. Further, it may be configured that the memory buttons 71A and 71B are arranged as the chord changing buttons as a fourth change method, and the assignment information is changed based on the user setting data read from the user setting database 123.

Further, in the above embodiment, when the chord changing part 111 changes the assignment state according to the second and third change methods, the display information generating part 113 generates the display information 90 for making the display part 9 display the chord images 900A to 900I corresponding to the chords after the assignment state is changed and change method images 901A to 901K as in the performance screen 90I illustrated I FIG. 10 and the performance screen 90K illustrated in FIG. 11; however, even when the chord changing part 111 changes the assignment state according to the first change method, the display information generating part 113 may similarly generate the display information 90. That is, the chord image 900A may include "C7" on the performance screen 90E illustrated in FIG. 8, and the chord image 900A may include "CM7" on the performance screen 90G illustrated in FIG. 9.

Further, in the above embodiment, the display information generating part 113 inverts the colors of the character and background when the display mode of the chord images 900A to 900I and change method images 901A to 901K is changed; however, the method of changing the display mode is not limited to this, and colors, patterns, figures, and the like may be changed as appropriate.

Further, in the above embodiment, the chord-playing input program 124 is executed by the control part 11 of the electronic musical instrument 1; however, it may be configured that the chord-playing input program 124 is executed by a control part provided in an electronic device such as a smartphone or a tablet terminal to allow the electronic device to function as the chord-playing input device 10. In this case, when the electronic device is provided with a touch panel, the display area of the touch panel may function in part or in entirety as the chord designating button group 3 and chord changing button group 4, or the display area of the touch panel may function in part or in entirety as the display part 9. Further, the touch panel may function as the chord designating button group 3, the chord changing button group 4, and display part 9. For example, the chord images 900A to 900I and change method images 901A to 901K displayed on the touch panel may function as the chord designating button group 3 and chord changing button group.

Further, in the above embodiment, the chord-playing input program 124 is stored in the storage part 12; however, it can be provided by being stored in a computer-readable recording medium, such as a CD-ROM, a DVD, or the like in an installable format file or an executable format file. Further, the chord-playing input program 124 may be stored in a server connected to a network such as Internet and downloaded over the network.

REFERENCE SIGNS LIST

1: Electronic musical instrument
2: Casing
3: Chord designating button group
3A to 3I: Chord designating button
4: Chord changing button group
4A to 4K: Chord changing button
5: Pad group
5A to 5D: Pad
6: Menu button
7: Option button group
8: Sounding part
9: Display part
10, 10A to 10D: Chord-playing input device
11: Control part
12: Storage part
13: Battery
14: External I/F part
20: surface
21: Back surface
22: Upper surface
23: Lower surface
24: Neck part
25: Body part
70A: Key up button
70B: Key down button
71A: Memory button
71B: Memory button
80: Sounding information
81A to 81D: Intermediate information
90: Display information
90A to 90M: Performance screen
91A to 91G: User setting screen
100A to 100C: First device
101A to 101C: Second device
102B, 102C: Third device
110: Operation receiving part
111: Chord changing part
112: Sounding information generating part
113: Display information generating part
120: Scale database
121: Playing method database
122: Sound source database
123: User setting database
124: Chord-playing input program
900A to 900I: Chord image
901A to 901K: Change method image
902: Menu image
903: Key image
F1 to F3: Finger

The invention claimed is:

1. A chord-playing input device comprising:

a plurality of chord designating buttons arranged on a casing and assigned respectively with chords;

a plurality of chord changing buttons arranged on the casing side by side with the chord designating buttons and assigned respectively with change methods for changing an assignment state of the chords for the chord designating buttons;

a sounding information generating part that generates sounding information for making a sounding part emit a sound of the chord corresponding to operation for any of the chord designating buttons and chord changing buttons; and a display information generating part that generates display information for making a display part display a plurality of chord images corresponding to the chords assigned respectively to the chord designating buttons and a plurality of change method images corresponding to the change methods assigned respectively to the chord changing buttons in the same arrangement order as those of the chord designating buttons and chord changing buttons, wherein the plurality of chord designating buttons are each assigned with a first root and a first chord type that constitute the chord, at least one of the plurality of chord changing buttons is assigned with, as the change method, mutually different third and fourth chord types to change the assignment state, and when the first chord type corresponds to the third chord type, the first chord type is replaced with the fourth chord type to change the assignment state, while when the first chord type corresponds to the fourth chord type, the first chord type is replaced with the third chord type to change the assignment state.

2. The chord-playing input device according to claim 1, wherein at least one of the plurality of chord changing buttons is assigned with, as the change method, a second chord type, which is added to the first chord type or with which the first chord type is replaced to change the assignment state.

3. The chord-playing input device according to claim 1, wherein at least one of the plurality of chord changing buttons is assigned with, as the change method, a change symbol, which is added to the first root to change the assignment state.

4. The chord-playing input device according to claim 1, wherein the sounding information generating part is configured to, when the chord designating button is operated, generate the sounding information based on the chord assigned to the operated chord designating button and configured to, when the chord designating button and chord changing button are operated simultaneously, generate the sounding information based on not the chord originally assigned to the operated chord designating button, but the chord which is newly assigned thereto by a change in the assignment state according to the change method assigned to the operated chord changing button.

5. The chord-playing input device according to claim 1, wherein the display information generating part is configured to, when the chord designating button is operated, generate the display information in which the display mode of the chord image corresponding to the chord assigned to the operated chord designating button has been changed and configured to, when the chord changing button is operated, generate the display information in which the display mode of the change method image corresponding to the change method assigned to the operated chord changing button has been changed.

6. The chord-playing input device according to claim 1, wherein the plurality of chord designating buttons and chord changing buttons are arranged within a range operable with one hand.

7. The chord-playing input device according to claim 1, wherein the plurality of chord designating buttons are arranged, as a chord designating button group, in a two-dimensional or staggered array.

8. An electronic musical instrument comprising:

the chord-playing input device as claimed in claim 1;

a sounding part that emits a sound of the chord based on sound information generated by the sound information generating part; and a display part that displays the plurality of chord images and the plurality of change method images based on display information generated by the display information generating part.

9. A computer-readable recording medium storing thereon an executable chord-playing input program for controlling a plurality of chord designating buttons arranged on a casing and assigned respectively with chords and a plurality of chord changing buttons arranged on the casing side by side with the chord designating buttons and assigned respectively with change methods for changing an assignment state of the chords for the chord designating buttons, when executed by a processor of a computer, performs operations comprising:

generating sounding information to emit from a sounding part a sound of the chord corresponding to operation for the chord designating buttons and chord changing buttons, and generating display information to display on a display part a plurality of chord images corresponding to the chords assigned respectively to the chord designating buttons and a plurality of change method images corresponding to the change methods assigned respectively to the chord changing buttons in the same arrangement order as those of the chord designating buttons and chord changing buttons, wherein the plurality of chord designating buttons are each assigned with a first root and a first chord type that constitute the chord, at least one of the plurality of chord changing buttons is assigned with, as the change method, mutually different third and fourth chord types to change the assignment state, and when the first chord type corresponds to the third chord type, the first chord type is replaced with the fourth chord type to change the assignment state, while when the first chord type corresponds to the fourth chord type, the first chord type is replaced with the third chord type to change the assignment state.

10. The chord-playing input device according to claim 1, further comprising a plurality of pads arranged on the casing, wherein the sounding information generating part generates the sounding information when the pads are operated.

* * * * *